United States Patent [19]

Smorzaniuk et al.

[11] 4,082,407

[45] Apr. 4, 1978

[54] TERMINAL BLOCK WITH ENCAPSULATED HEAT SINK

[75] Inventors: Adam Smorzaniuk, West Millington; Paul F. Lindlau, East Orange, both of N.J.

[73] Assignee: Amerace Corporation, New York, N.Y.

[21] Appl. No.: 798,900

[22] Filed: May 20, 1977

[51] Int. Cl.[2] ..... H01R 13/00

[52] U.S. Cl. ..... 339/112 R; 339/17 M; 361/388

[58] Field of Search ..... 339/112 R, 17 M, 275 T; 361/386, 388

[56] References Cited

U.S. PATENT DOCUMENTS

| | | | |
|---|---|---|---|
| 2,952,786 | 9/1960 | Lewis | 361/386 X |
| 3,912,353 | 10/1975 | Kasuya et al. | 339/112 R X |

*Primary Examiner*—Roy Lake

*Assistant Examiner*—DeWalden W. Jones

*Attorney, Agent, or Firm*—S. Michael Bender; Ken Richardson

[57] ABSTRACT

A printed circuit panel connector comprises an encased heat sink for maintaining all electrical connections to the connector at substantially the same temperature. The heat sink is disposed between a plurality of tubular electrical connector elements adapted to receive corresponding external conductors, and a like plurality of electrical contact elements for making electrical connections between each one of the tubular electrical connector elements and a corresponding terminal adjacent the edge of a printed circuit board. Portions of the contact elements are in spring loaded contact with the heat sink such that the heat sink positively retains the contact elements within the terminal block body and maintains the various tubular electrical connector elements and electrical contact elements at substantially the same temperature.

16 Claims, 6 Drawing Figures

TERMINAL BLOCK WITH ENCAPSULATED HEAT SINK

BACKGROUND OF THE INVENTION

1. Field of the Invention

The present invention generally relates to electrical connectors and, more particularly, to a printed circuit panel connector comprising a heat sink therein such that all electrical connections to the printed circuit panel connector are maintained at substantially the same temperature.

2. Description of the Prior Art

An undesirable feature in conventional printed circuit panel connectors, which are utilized as an interface between a plurality of external conductors and the terminals of say a printed circuit board, is the inability to maintain all electrical connections at the printed circuit panel connector at essentially the same temperature (printed circuit is hereinafter referred to as PC). This undesirable feature is a serious handicap in electrothermic applications such as, for example, PC assemblies for thermal measuring communication power systems, of which the following are a few of the several types possible: data acquisition systems, data logger systems, and scanner systems. As is well known, the circuitry consisting of the electrical connections that interface with the PC connectors used in the above systems, as well as the printed circuitry of the PC boards and/or assemblies, may incorporate therein a variety of electrothermic devices or instruments like: thermocouples, thermistors, bridge transducers and bolometers, etc.

The operation of these devices, generally speaking, depends upon the heating effect of current flow seen by the electrical connections circuitry. They are employed to detect, measure, or indicate thermal characteristics or data. However, when employed in the network of electrical connections in conventional PC connectors, the acquired thermal data is for the most part useless, or inaccurate and unreliable at best, if the several electrical connections are not maintained at an even, constant, and substantially identical temperature throughout the interval of time required to obtain the desired thermal data. Unequal temperatures along the electrical connections virtually destroy all chances for obtaining accuracy, reliability, and repeatability. Repeatability being herein used to mean the ability to acquire successive and accurate readings during the time interval designated to collect the desired thermal data.

Several approaches in PC connector design have been made with the objective to produce a PC connector capable of eliminating this elusive undesirable feature. One such common practice of which applicants are aware is to insert a removable rectangular sheet configured heat sink between rows of contact elements received within corresponding tubular connectors in a terminal block. Each contact element is adapted to be electrically connected between its complementary tubular connector and a corresponding PC board terminal, with physical contact between the tubular connector and the heat sink being made subsequent to the latter's insertion between the rows of contact elements.

However, this practice fails to effectively eliminate the aforesaid undesirable feature because irregularities in the sheet configured surface of the heat sink often prevents the heat sink from making positive contact with all of the tubular connectors. In addition, pressing forces required to insert and/or remove the heat sink frequently either break some of the contact elements within the socket of the connector, or open the connection between the heat sink and some of the tubular connector elements. Still further, the foregoing practice involves fabricating the connector from a multiple number of connector parts and a multiple number of contact element parts, and involves the use of fastener hardware, which consequently increases material, tooling, machining and overall manufacturing costs. Finally, the known multiple-piece constructed connectors increase the chance of wider than expected tolerances occuring between mating parts which, in turn, also may result in lack of positive contact between the heat sink and many of the contact elements of the connectors.

In another prior art approach known to applicants, a conventional PC panel connector has heat sinks mounted upon an external surface of the connector; however, this solution is disadvantageous since externally mounted heat sinks are often cubersome or unwieldy, and thus, waste precious space on the connector otherwise suitable for external connector positions and PC panel terminal positions.

Against the foregoing background, it is an object of this invention to provide an improved arrangement between a heat sink, a plurality of tubular electrical connector elements, and a corresponding plurality of electrical contact elements within the body of a PC panel connector.

It is another object of this invention to provide a PC connector heat sink that is capable of maintaining all electrical connections to a PC edge-board connector of substantially the same temperature.

It is a further object of this invention to provide a PC edge-board connector, in the form of a terminal block, whereby an encased heat sink is uniquely disposed among an encircling plurality of ordered electrical contact elements and a plurality of tubular electrical connector elements thereby to optimize available space for such connector element positions and PC board terminal positions.

It is an additional object of this invention to provide a PC edge-board connector having a plurality of one-piece electrical contact elements that are positively retained within the block, by an encapsulated heat sink, to prevent movement thereof when subjected to shock and vibratory environmental conditions.

It is yet another object of this invention to provide a unitary PC edge-board connector comprising an encased heat sink and which is relatively inexpensive to fabricate.

It is still another object of this invention to provide a PC edge-board connector, of a unitary terminal block configuration, applicable in PC assemblies for thermal measuring communication power systems, which includes an encased heat sink uniquely arranged among an ordered plurality of tubular electrical connector and electrical contact elements, for maintaining all interfacing electrical connections to the connector at substantially the same temperature, thereby enabling accuracy, reliability, and repeatability of determined thermal data.

SUMMARY OF THE INVENTION

To the accomplishment of the foregoing objects and advantages, the present invention in brief summary comprises a printed circuit panel connector, in the form of a unitary terminal block which, in turn, comprises an encased heat sink for maintaining all electrical connections to the block at substantially the same temperatures. The heat sink is disposed between a plurality of tubular electrical connector elements adapted to receive corresponding external conductors, and a like plurality of electrical contact elements for making electrical connections between each one of the tubular electrical connector elements and a corresponding terminal adjacent the edge of a printed circuit board. Portions of the contact elements are in spring loaded contact with the heat sink such that the heat sink positively retains the contact elements within the terminal block body and maintains the various tubular electrical connector elements and electrical contact elements at substantially the same temperature.

BRIEF DESCRIPTION OF THE DRAWINGS

The foregoing and still other objects and advantages of the present invention will be made more apparent from the following detailed explanation of the preferred embodiments of the invention in connection with the accompanying drawings wherein.

DETAILED EXPLANATION OF THE PREFERRED EMBODIMENTS OF THE INVENTION

Figure 1:
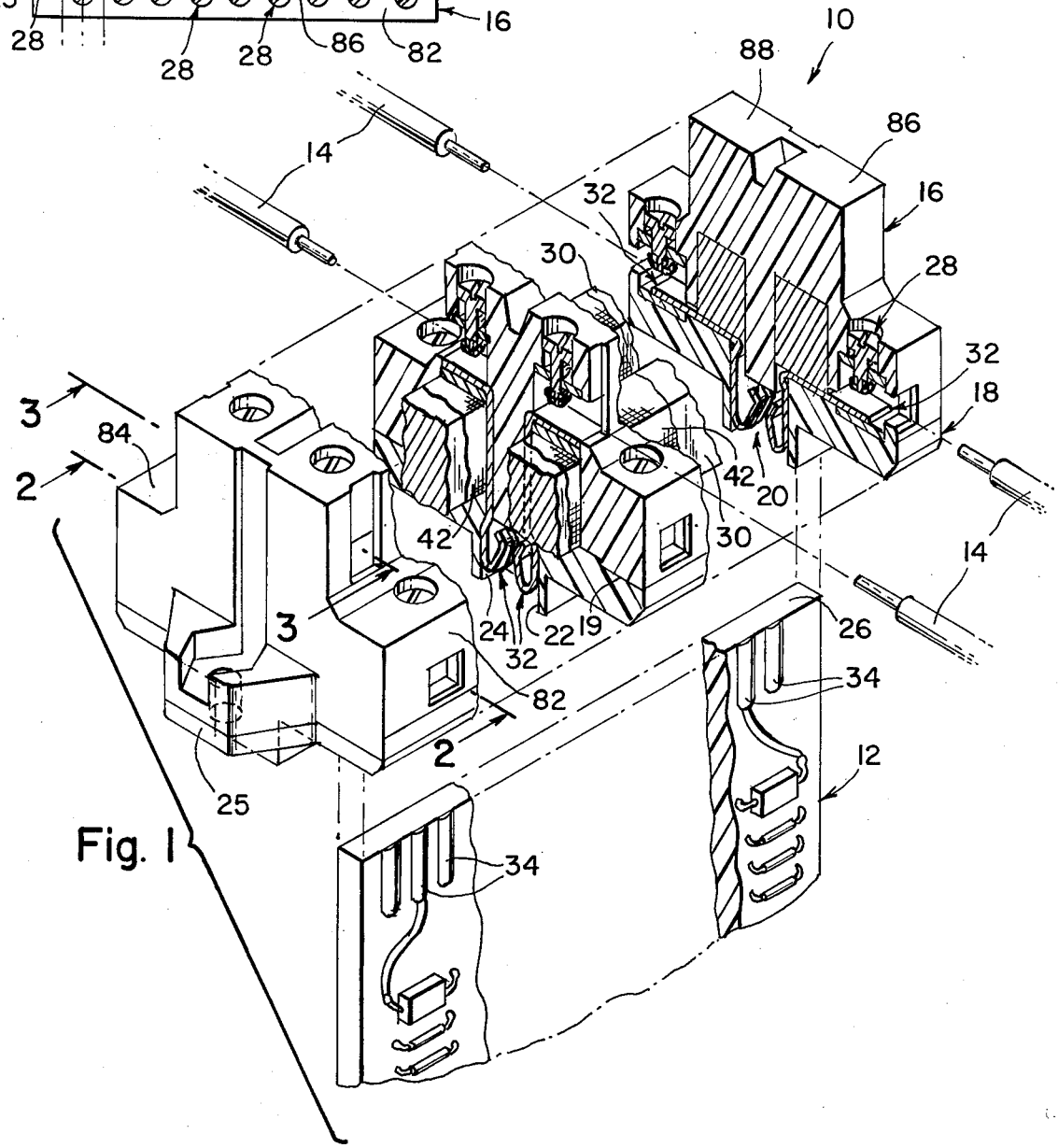
FIG. 1 is a partially exploded, partially broken away, perspective view illustrating a PC panel connector constructed in accordance with the invention.
Figure 2:
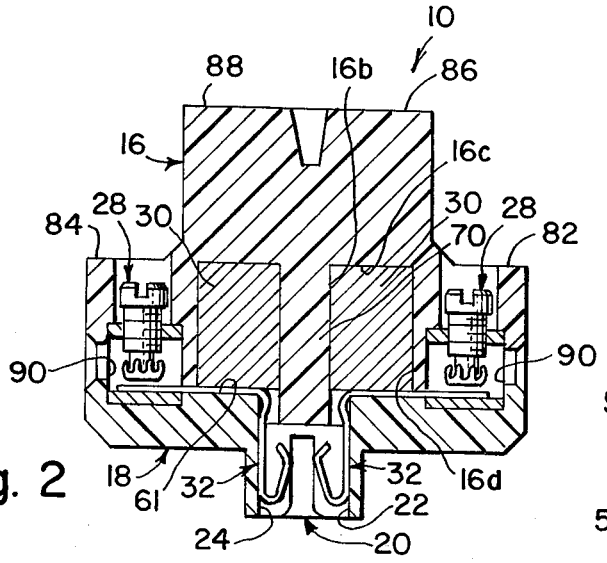
FIG. 2 is a lateral cross-sectional view of the connector of FIG. 1 taken along lines 2—2 of FIG. 1.
Figure 3:
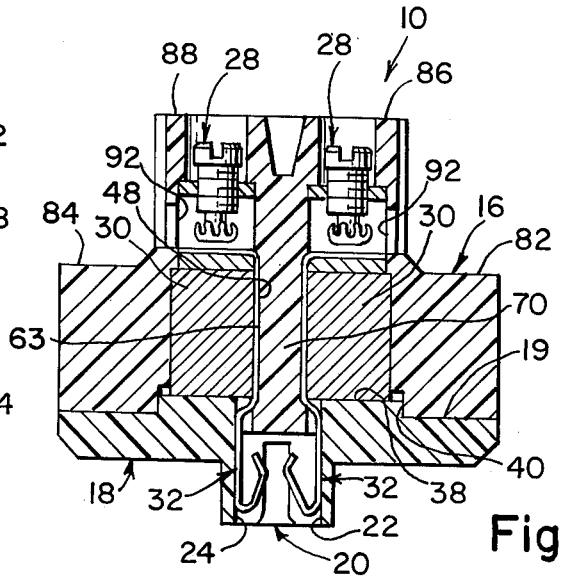
FIG. 3 is a lateral cross-sectional view of the connector of FIG. 1 taken along lines 3—3 of FIG. 1.

Referring initially to FIGS. 1-3, there is shown an electrical connector of the present invention, generally indicated by reference numeral 10, having the capabilities for making ready electrical connections between a circuit panel 12 (e.g., a printed circuit board) and a plurality of external conductors 14. Connector 10 may be in the form of a unitary terminal block, and is preferably molded in a known manner from a synthetic polymeric material, e.g., nylon, polyproplene or phenolic. Thus, it will be appreciated that the term "synthetic polymeric material" as used herein, is to construed to cover both thermoplastics and thermoset materials. Although connector 10 is preferably molded from synthetic polymer materials, be it understood that other suitable materials having adequate insulating and strength characteristics upon being molded or otherwise formed may be employed, as will occur to those skilled in the art.

Connector 10 comprises an upper body 16 and a lower body 18 joined together in a known manner along a pair of complementary transverse surfaces which interfit tightly relative to one another along common joint line 19. Lower body 18 includes an elongated generally rectangular socket 20 having a pair of spaced internal opposed side walls 22 and 24. The longitudinal extremities of socket 20 terminate respectively short of either opposed longitudinal extremity of the connector 10, and the socket 20 is adapted to receive the terminal bearing edge 26 of circuit panel 12 as is well known in the art.

A through-aperture having a hex-shaped nut receiving portion and a cylindrical portion for mounting the connector to a support with a threaded fastener or similar means is provided at each longitudinal extremity thereof as indicated generally by reference numeral 25. Aperture 25 may also be in the form of conventional eyelets or have other known shapes adaptable for receiving complementary configured fasteners.

In one broad aspect of the invention, upper body 16 includes therein substantially as shown a plurality of longitudinally spaced tubular electrical connector elements 28, for electrically receiving complementary or corresponding external conductors 14; at least one thermally conductive electrically insulated member of heat sink 30 for absorbing heat dissipated from electrical components and/or interfacing electrical connections associated with connector 10; and a corresponding plurality of electrical contact elements 32, adapted to form an electrical bridge, or connection between corresponding tubular electrical connectors 28 and PC board terminal elements 34.

Tubular electrical connectors 28 are positioned or captured interiorly within a longitudinally extending portion of upper body 16 of connector 10 in a known manner and preferably may take the form of conventional tubular clamp connector elements fully described, for example, in patent No. 3,930,706, incorporated herein by this reference. As taught in the aforementioned patent No. 3,930,706, such tubular electrical connector elements are adapted to releasably clamp an external conductor 14 received therein and maintain a secure electrical connection between the conductor and a strap or portion of an electrical contact element 32 also received therein.

Heat sink 30 comprises an elongated thermally conductive member which may be produced from any well known variety of suitable heat conductive materials, such as, for example, aluminum, copper, silver bearing copper, etc. Notably, heat sink 30 is not limited to the rectangular bar configuration depicted in the drawing, but alteratively, may be in the form of a channel-bar, hollow bar, cylindrical bar, or any othr geometrical shape suitable for functioning as a heat sink in accordance with the present invention, as will occur to those skilled in the art.

Heat sink 30 is located interiorly of the body of connector 10 within a suitably sized recess in upper body 16, and is positioned to extend longitudinally therein. As best seen in FIG. 3, the longitudinally bottom surface or side of heat sink 30 rests on a raised internal planar surface portion 38 of lower body 18, at approximately the vicinity where upper and lower body 16 and 18 are integrally joined together along joint line 19. The raised portion 38 defines a shoulder 40 which is press-fit into engagement against the opposed wall surface of upper body 16, and thus, helps to maintain the intended interfitted engagement of the upper and lower body parts as is well known in the art. The remaining three longitudinally extending sides of heat sink 30 bear immovably against internal portions of upper body 16 generally designated as **16*b*, 16*c* and 16*d* respectively (see FIG. 2**).

Heat sink 30 includes thereon a wrapping or coating 42 of thermally conductive electrically insulative material so as to electrically insulate longitudinally adjacent tubular connections 28 and contact elements 32 from one another respectively, and thus prevent heat sink 30 from forming a short circuit between individual circuits connected through connector 10 all of the while permitting heat sink 30 to absorb heat dissipated from either or both the tubular electrical connections 28 or the electrical contact elements 32 of connector 10, or other electrical components associated with the PC panel 12 and external conductors 14. A few well known examples of thermally conductive, electrically insulative materials suitable for use as coating 42 include flurocarbon polymer materials, beryllium oxide materials, epoxy compounds, porcelain, and synthetic polymer materials (e.g., polyester).

Referring by way of example to FIG. 2, each electrical contact element 32 comprises a strip or strap of electrically conductive material (e.g., copper, gold-plated copper, bronze, or brass) positioned or oriented within connector 10 such that one end thereof extends from within or between the opposed side walls 22 and 24 of socket 20, the other end thereof is received within tubular electrical connection 28, and a medial portion thereof is positively engaged between a longitudinally extending surface of heat sink 30 and a confronting portion of the body of connector 10 so as to achieve positive contact with the heat sink 30, as will be more fully explained hereinafter.

Figure 4:
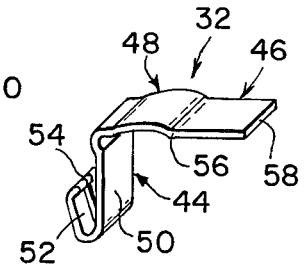
FIG. 4 is a detailed perspective of one form of electrical contact element employed in the connector of the invention.

Turning now to FIG. 4, the contact element 32 will now be described in even more detail. Each contact element 32 preferably is of one-piece construction, and includes a socket contact portion 44 for electrically mating with or connecting to a terminal 34 carried by PC panel 12, which terminal 34 may be typically positioned on either side of two sided board-edge 26; a connecting portion 46, for electrically engaging or mating with a corresponding electrical connector element 28; and an intermediate resiliently flexible bowed portion 48 that electrically bridges portions 44 and 46 of the contact element.

The socket contact portion 44 has a generally U-shaped configuration, which includes a substantially straight leg portion 50. The substantially straight leg portion 50 is juxtaposed to or rests against one of the opposed side walls 22 or 24 of socket 20. The remaining leg portion 52 of the generally U-shaped socket contact portion 44 is resiliently biased to a position away from one of the walls 22 or 24 associated with or in juxtaposition with the substantially straight leg portion 50. The foregoing arrangement allows the leg portion 52 in the U-shaped region 44 to deflect inwardly and positively electrically engage a corresponding PC terminal 34 when terminal bearing boardedge 26 is inserted into socket 20.

Notably, U-shaped leg portion 52 may comprise either a single prong contact structure (not shown), or a double prong bifurcated contact structure 54 as depicted in FIG. 4. The bifurcated contact structure 54 is preferred since it may eliminate failure at the contact interface between contact element 32 and PC panel terminal 34 by, for example, loss of continuity due to contamination. Under this condition should contamination prevent one prong of the two-prong configured bifurcated contact to stop conducting, the remaining prong would be available; or by the loss of complete contact between contact element 32 and PC panel terminal 34, if by some mishap one prong should break off. In the latter condition, the remaining unbroken prong would still be in positve electrical contact with terminal 34.

The connecting portion 46 is of substantially flat form and merges at end 56 thereof into the intermediate bowed portion 48 of the electrical contact element. The remaining end part 58 is adapted to be received into the tubular portion of connector 28, and preferably in contact with the latter's bottom portion substantially as shown for electrically connecting the electrical contact element 32 to the corresponding tubular electrical connector element 28.

Figure 5:
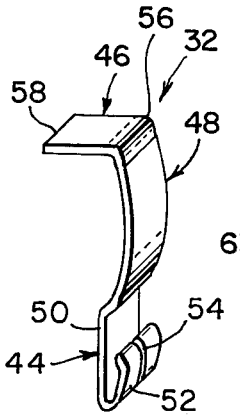
FIG. 5 is a detailed perspective of another form of electrical contact element employed in the connector of the invention.

In the preferred embodiment of the present invention to be described in more detail below, the electrical contact element 32 takes two slightly different forms. Thus, in the version illustrated in FIGS. 2 and 4, for example, connecting portion 46 and intermediate bowed region 48 form a straight extending segment, while socket contact portion 44 is offset in a dog-leg or extends nearly at right angles with flat connecting and intermediate bowed portions 46 and 48; whereas in the version illustrated in FIGS. 3 and 5, for example, socket contact portion 44 and bowed portion 48 form a straight extending segment, while connecting portion 46 is offset in a dog-leg or extends at nearly right angles relative to both the socket contact portion 44 and the bowed intermediate portion 48.

In both versions, the intermediate resiliently flexible bowed segment 48 is adapted to be positioned between an internal surface of either upper and lower body 16 and 18 within connector 10 as the case may be, and a corresponding confronting surface of heat sink 30 such that the intermediate segment 48 is resiliently urged into positive spring-loaded contact or engagement with the corresponding confronting surface of heat sink 30 when the contact elements 32 are inserted into position and the upper and lower body parts of connector 10 are interfitted relative to each other during assembly.

Thus, with respect to the version of the electrical contact element 32 shown in FIG. 2, the intermediate portion 48 is received in a suitably sized slot or clearance space 61 provided in the raised planar portion 38 of the lower body 18 and the resilient bowed portion 48 is urged into a flattened condition between opposed confronting surface of heat sink 30 and the bottom surface of slot 61.

Likewise with respect to the version of contact element 32 shown in FIG. 3, the intermediate portion 48 is received in a suitably sized slot or clearance space 63 provided in surface **16*b* of upper body 16 and the resilient bowed portion 48 is urged into a flattened condition by the confronting action of the longitudinally extending side wall surface of heat sink 30 and the opposed confronting bottom surface of slot 30 provided in wall surface 16*b*. By virtue of the intermediate bowed segment 48 being inwardly deflected, heat sink 30 in accordance with the present invention functions to positively capture or retain contact element 32 within connector 10 and prevent any outward movement thereof when the connector is subjected to severe shock or vibration, and secondly, the positive resilient spring action of the bowed portion maintains a positive contact between the contact element 32 and the heat sink 30 thus facilitating transfer of heat from the electrical contact and/or electrical connector 28** to the heat sink and vice versa.

It will be appreciated that the intermediate portion 48 of the contact elements 32 may also be coated with or encased in any of the aforementioned thermally conductive electrically insulative materials to electrically insulate the heat sink 30 and the contact elements 32 from one another while still permitting heat sink 30 to absorb heat carried by these contact elements.

In accordance with the invention, the preferred embodiment of connector 10 is in the form of a dual heat sink, 18 position, 36 circuit terminal block. Connector 10 has length, height, and width dimensions of approximately 3¾ inches (95.mm), 1½ inches (38.mm), and 1½ inches (38.mm), respectively. The double terminal board-edge of a PC panel having a thickness of 0.062 inches nom. (1.57mm. nom.) is adapted to be received in mating engagement into socket 20 of the connector.

The dual heat sinks 30, tubular electrical connector elements 28, and electrical contact elements 32, of the preferred embodiment, are uniquely arranged within the body of connector 10, with respect to one another, to create a compact, lightweight design having a relatively high number of available tubular electrical connector positions.

To this end, and substantially as shown, the preferred embodiment of connector 10 includes two encapsulated laterallyspaced parallel-extending elongated solid-copper rectangular-configured heat sinks 30. The two heat sinks 30 are positioned within suitable recesses in connector 10 on eithr side of a central partition 70 integral with upper body 16, and extend substantially the entire axial length of the connector body terminating short of the extremities thereof so that the heat sinks are completely encased within the connector body.

Figure 6:
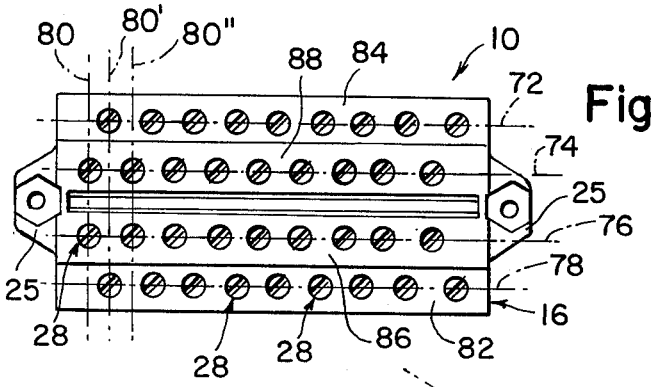
FIG. 6 is a schematic layout of the top of the connector of the present invention diagramatically showing the close spacing arrangement of the connectors therein.

The preferred embodiment of connector 10 includes two pairs of rows of longitudinally spaced tubular electrical connector elements 28; a first pair of outboard rows indicated by center lines 72 and 78 in FIG. 6, and a pair of inboard rows indicated by centerlines 74, 76 in FIG. 6. Still referring to FIG. 6, the outboard pair of rows 72, 78 are longitudinally staggered relative to the two inboard rows, 74, 76 to form alternating columns of inboard and outboard pairs of tubular electrical connectors 28 which are indicated by the vertical centerlines 80, 80', 80'', etc.

Thus, if one were to observe the interior of the connector 10 by starting at the leftmost end of the connector and taking successive transverse sectional views corresponding to each column centerline, the first such sectional view corresponding to column 80 would appear as FIG. 3 herein and the next sectional view corresponding to column 80' would appear as FIG. 2 herein. It will be understood that this alternating pattern of outboard and inboard pairs of tubular electrical connectors 28 repeats as the hypothetical observer progresses longitudinally through the connector to the rightmost end thereof as viewed in FIG. 6.

Each heat sink 30 in the preferred embodiment is wrapped or coated with a layer of polyester tape having a thickness of about 0.003 inches (0.076mm) (designated as 42) to electrically insulate the heat sinks 30 and electrical contact elements 32 from one another.

The two outboard rows 72, 78 of tubular electrical connectors 28 are longitudinally positioned in suitably spaced manner within a corresponding pair of outboard sections 82, 84 of upper body, whereas the two inboard rows 74, 76 of tubular electrical connectors 28 are likewise longitudinally positioned in suitably spaced manner within a corresponding pair of inboard sections 86, 88 of upper body 16. Thus, as best seen in FIGS. 2 and 3, the outboard sections 82, 84 are laterally adjacent the heat sinks 30, and the inboard sections 86, 88 are positioned above the heat sinks 30, respectively.

The tubular electrical connectors 28 in each outboard section 82, 84 of the connector are maintained in position within respective suitable recesses 90 each of which has an upper portion in upper body 16 and a lower portion in lower body 18 substantially as shown in FIG. 2. Thus, during assembly, the tubular electrical connector 28 corresponding to the two inboard rows 74, 76 (FIG. 6) are inserted into their respective recesses 92; and the corresponding electrical contact elements 32 placed into position. Alternatively, the electrical contact elements 28 may be inserted into the tubular electrical connectors 28 to form thereform a single element, which single element is positioned into the upper and lower body 16 and 18. This latter assembly sequence is preferred. The heat sinks 30 are then emplaced within their recesses in the upper body portion 16 and the lower body portion 18 is then interfitted relative to the upper body portion 16 to securely maintain and capture the tubular electrical connectors 28 in the position shown within the recesses 92.

Of course, it will be appreciated that during assembly the tubular electrical connectors 28 corresponding to the inboard rows 74, 76 (FIG. 6) are inserted first followed by insertion of their respective contacts 32 and the two heat sinks 30, and then the tubular electrical connectors 28 corresponding to the outboard rows 72, 78 (FIG. 6) are inserted into their respective recesses 90 followed by interfitting engagement of the lower body 18 relative to the upper body 16.

It will be noted that there is a separate contact element 32 for each tubular electrical connector 28 in each of the rows 72, 74, 76 and 78, and that the two contact elements 32 corresponding to each column 80, 80', 80'', etc. are associated with a different one of said two heat sinks, respectively, with a different one of said opposed side walls 22 or 24 of the socket 20, and that the contact elements 32 alternate in form from column to column. Thus, as shown in FIG. 3, the electrical contact elements corresponding to column 80 of FIG. 6 extend from between the opposed side walls 22, 24 of socket 20 through the recesses 63 provided in partition 70 of upper body 16 thence into the tubular body portion of tubular electrical connector 28; and similarly as shown in FIG. 2, the electrical contact elements corresponding to column 80' in FIG. 6 extend from between the opposed side walls 22, 24 of socket 20 through recesses 61 provided in raised planar surface 38 thence into the tubular body portion of their corresponding tubular electrical connectors 28. In both cases, however, it will be appreciated that the intermediate flexible bowed segment 48 of each electrical contact element 32 results in each contact element being maintained in positively spring-loaded engagement between the heat sinks and a corresponding opposed confronting surface of the body of connector 10, respectively. By virtue of the foregoing arrangement, heat concentrated at a particular electrical tubular connection, or PC panel terminal will flow through a corresponding electrical contact 32 thence into heat sink 30 which latter distributed the heat evenly among each of the contact elements, in engagement therewith and thus maintains each of the contact elements, and/or each of the connections to connector 10 at substantially the same temperature.

From the foregoing it will be apparent that the present invention discloses an improved electrical connector having the capability of maintaining all electrical connections thereto substantially at the same temperature. By encapsulating an elongated heat sink within the body of the connector in accordance with the present invention and by providing a plurality of electrical contact elements in spring-loaded positive engagement against portions of the elongated heat sink yet maintaining electrical isolation of the individual electrical contact elements, the heat sink helps to retain the contact elements in position within the connector body and moreover, absorbs heat via the contact elements in thermal engagement therewith from either the external conductors connected to the tubular electrical connectors of the connector or from the PC panel terminals cooperatively associated therewith.

It should be understood that the above detailed description of the preferred embodiments of the invention is provided by way of example only to satisfy the requirements of statute. Various details of design and construction may be modified without departing from the true spirit and scope of the invention, as set forth in the appended claims.

We claim:

1. An electrical connector for serving as an interface between a circuit panel and a plurality of external conductors comprising:

(a) a body member of electrically insulative material having an elongated socket for receiving an edge of a circuit panel therein;

(b) at least one longitudinally extending thermally conductive member disposed in a recess in said body and being entirely surrounded by the electrically insulative material of said body;

(c) a plurality of electrical connected members in said body for receiving a corresponding plurality of external conductors;

(d) a like plurality of electrical contact elements, each of said contact elements being situate in said body member such that a first portion of each one of said contact elements extends into said socket to engage a terminal on a circuit panel inserted into said socket, a second portion engages said thermally conductive member for transferring heat into and away from said thermally conductive member, and a third portion engages a corresponding one of said plurality of electrical connector members.

2. The electrical connector as recited in claim 1 wherein said at least one longitudinally extending thermally conductive member comprises an external electrically insulative coating thereon.

3. The electrical connector as recited in claim 1 wherein said second portion comprises a resiliently flexible region that electrically bridges said first and second portions, said region being adapted to be positioned between an internal surface of said connector and a corresponding confronting surface of said thermally conductive member such that said region is resiliently urged into positive spring-loaded contact with said confronting surface of said thermally conductive member.

4. The electrical connector as recited in claim 1 wherein said first portion of said contact elements comprises a substantially straight leg region and a generally U-shaped region, said straight leg region being juxtaposed to rest adjacent one opposed side wall of said socket, said U-shaped region being resiliently biased to a position away from said one opposed side wall said juxtaposed therewith, whereby said U-shaped region is deflected inwardly to positively engage a corresponding said terminal on said circuit panel.

5. The electrical connector as recited in claim 4 wherein said third portion of said electrical contact elements comprises a substantially flat configuration, said third portion being adapted to be received by corresponding ones of said connector members.

6. The electrical connector as recited in claim 5 wherein said second portion comprises a resiliently flexible region that electrically bridges said first portion and said second portion, said resiliently, flexible region being adapted to be positioned between an internal surface of said connector and a corresponding confronting surface of said conductive member such that said region is resiliently urged into positive spring-loaded contact with said confronting surface of said conductive member.

7. The electrical connector as recited in claim 6 wherein said resiliently, flexible region and said third portion form a straight extending segment, while said first portion is offset at nearly right angles with said formed straight extending segment.

8. The electrical connector as recited in claim 6 wherein said first portion and said resiliently, flexible portion form a straight extending segment, while said third portion is offset at nearly right angles with said formed straight extending segment.

9. An electrical connector for serving as an interface between a circuit panel and a plurality of external connectors comprising:

(a) a body member of electrically insulating material having an elongated socket for receiving an edge of a circuit panel therein;

(b) two encapsulated laterally-spaced parallel-extending thermally conductive members, said members being surrounded by the electrically insulative material of said body;

(c) a first and second pair of rows of electrical connector members for receiving corresponding external conductors, each said first and second pair of rows respectively being astraddle a median line passing longitudinally through said connector body, said first pair being positioned closer to said median line than said second pair, said first pair being longitudinally staggered relative to said second pair to form alternating columns of inboard and outboard pairs of said electrical connector members;

(d) separate electrical contact elements for each said electrical connector members in each said first and second pairs of rows, wherein each said separate contact element in said first and second pairs is respectively associated with a different one of said two thermally conductive members and wherein said separate electrical contact elements are situate in said body member such that a first portion of each said separate contact element extends into said socket to engage a circuit-panel terminal, a second portion engages said associated thermally conductive member, and a third portion engages said corresponding electrical connector member.

10. The electrical connector as recited in claim 9 wherein said first portion is a U-shaped socket contact region, said third portion is a substantially flat connecting region and said second portion is a resiliently flexible region that electrically bridges said U-shaped region and said connecting region.

11. The electrical connector as recited in claim 9 wherein said electrical contact member comprises a first form, wherein said connecting region and said resiliently flexible region merge with one another into a straight extending segment, while said socket contact region is offset at nearly right angles with said merged straight extended segment.

12. The electrical connector as recited in claim 11 wherein electrical contacts comprise a second form, wherein said resiliently flexible region and said socket contact region merge with one another into a straight extending segment, while said connecting region is offset at nearly right angles to said merged straight extended segment.

13. The electrical connector as recited in claim 12 wherein said electrical contact elements alternate between said first and second form in said alternating columns of inboard and outboard rows of said electrical contact.

14. The electrical connector as recited in claim 13 wherein each said separate electrical contact element in said first and second pairs is respectively associated with a different one of two opposed side walls of said socket.

15. The electrical connector as recited in claim 14 wherein said two encapsulated laterally-spaced parallel extending conductive members comprise exterior electrically insulative coatings thereon.

16. An electrical connector for serving as an interface between a circuit panel and a plurality of external conductors comprising:

(a) a body member of electrically insulative material having an elongated socket for receiving an edge of a circuit panel therein, said body member including first and second parts interfitted together, said elongated socket being disposed in said second part;

(b) at least one longitudinally extending thermally conductive member disposed in a recess in said first part of said body member and being entirely surrounded by the electrically insulative material of said body;

(c) a plurality of electrical connector members in said body member first part for receiving a corresponding plurality of external conductors;

(d) a like plurality of electrical contact elements, each of said contact elements being situate in said body member such that a first portion of each one of said contact elements extends into said socket in said second part to engage a terminal on a circuit panel inserted into said socket, a second portion engages said thermally conductive member for transferring heat into and away from said thermally conductive member, and a third portion engages a corresponding one of said plurality of electrical connector members in said body member first part.

* * * * *